United States Patent [19]

Sellers

[11] 3,946,780

[45] Mar. 30, 1976

[54] FERMENTATION CONTAINER

[76] Inventor: John C. Sellers, 507 Signal Hill Road, Barrington, Ill. 60010

[22] Filed: Jan. 4, 1973

[21] Appl. No.: 320,911

[52] U.S. Cl. ..... 150/8; 99/277.1; 195/142; 426/8; 426/15; 426/118

[51] Int. Cl.[2] ..... B65D 33/16

[58] Field of Search ..... 229/62.5; 150/8; 215/248; 206/439, 365; 128/272; 220/60 R; 426/8, 15, 118, 130, 395; 195/142, 144; 99/277.1

[56] References Cited

UNITED STATES PATENTS

| | | | |
|---|---|---|---|
| 2,186,888 | 1/1940 | Tuller et al. | 215/248 |
| 2,638,263 | 5/1953 | Jesnig | 229/62.5 |
| 2,804,257 | 8/1957 | Hasler et al. | 229/62.5 |
| 3,021,942 | 2/1962 | Hamilton | 206/365 |
| 3,032,182 | 5/1962 | Bechtold | 206/439 |
| 3,343,719 | 9/1967 | Kastamo et al. | 229/62.5 |
| 3,468,471 | 9/1969 | Linder | 229/62.5 |
| 3,485,352 | 12/1969 | Pilger | 206/365 |
| 3,559,834 | 2/1971 | Taylor | 426/118 X |
| 3,642,047 | 2/1972 | Waage | 150/8 |
| 3,685,679 | 8/1972 | Heffran | 220/44 C |
| 3,685,720 | 8/1972 | Brady | 229/62 |
| 3,760,711 | 9/1973 | Webster | 99/277.1 |
| 3,761,013 | 9/1973 | Schuster | 206/439 |

*Primary Examiner*—William I. Price
*Assistant Examiner*—Stephen P. Garbe
*Attorney, Agent, or Firm*—Mason, Kolehmainen, Rathburn & Wyss

[57] ABSTRACT

A flexible fermentation container which has, in place of the common air lock, a diaphragm having a Gurley porosity of 2 to 120 seconds. The diaphragm material, such as spun bonded polyethylene, allows fermentation gases to pass out of the container, but does not allow bacteria or other contaminants to enter.

12 Claims, 7 Drawing Figures

FERMENTATION CONTAINER

This invention relates to the making of fermented beverages such as beers, wines and liquors in whatever quantity desired and it is especially suitable for the production of wine in small quantities. More particularly, this invention relates to a new container in which the fermentable juices or mashes are fermented to produce an alcoholic beverage.

One object of the present invention is to provide a container for fermentation which is inexpensive and can therefore be thrown away together with sediment after fermentation.

Another object of the present invention is to provide a container for fermentation which requires no water traps or air locks or attached tubes and yet prevents vinegar-forming bacteria from entering the container while allowing the escape of $CO_2$ formed during fermentation.

Another object of the present invention is to provide a fermentation container which is inexpensive and easy to use by the average consumer who knows nothing about the fermentation process.

A further object of the present invention is to provide a fermentation container which does not allow the entry of contaminants, such as micro-organisms or moisture, over extended periods of use.

Another object of the present invention is to provide a fermentation container in which the means for escape of $CO_2$ can be adjusted in size according to the volume of liquid to be fermented so that container pressure does not become excessive.

A further object of the present invention is to provide a fermentation container which does not have to be washed, sterilized or rinsed.

Another object of the present invention is to provide a fermentation container in which the fermentation lock can be eliminated.

A further object of the present invention is to provide a fermentation container which is easy to handle, space saving, economical and saves considerable labor in the fermentation process.

This invention is particularly suited for use as a home wine-making kit but can be made in sizes up to 50 gallons or more so that even commercial wine-making is practical and economical by this method.

BACKGROUND OF THE INVENTION

The home wine-making kits which can be found on the market today have re-usuable, permanent fermentation containers which are expensive and cumbersome and which must be washed, sterilized and rinsed after each batch of wine. This invention relates to a new container particularly adapted for use in the home wine-making kit which is inexpensive enough that it can be discarded after each use. The container is not a permanent, rigid structure but is made from a flexible, inexpensive plastic bag.

The type of nonporous plastic bag used with this invention is not critical. When using the container described herein, the pressure build-up is not great enough to burst any of the common plastic bags found on the market today. Common inexpensive plastic bags which can be used are, for example, made from a polyolefin such as polyethylene or polypropylene, or ethylene-vinyl acetate copolymer. Polyurethane bags function very well, but are more expensive than those listed above. Other types of laminated or coated bags can be used such as a bag made from one layer of polyvinylidene chloride and one or two layers of polyethylene (each layer of each material having a 1 to 2 millimeter thickness). One type of plastic bag which works quite well is made by the coextrusion of polyethylene and polyvinylidene chloride. However, any plastic bag can be used. Preferably, the bag will be heat sealable. In place of the common fermentation lock, applicants use a fitment sealed into an opening in the plastic bag. A cap which has a diaphragm sealed to its inside or outside diameter is sealingly engaged to the inside diameter of the fitment and allows the escape of $CO_2$ which has been formed during the fermentation process. While allowing the escape of $CO_2$, this cap does not allow the entrance of bacteria organisms, spores or any contaminant liquid or solid. The cap can be made from any nonporous material; plastic, e.g. polyethylene, is preferred because it is inexpensive.

Contaminants which are particularly undesirable in the formation of wine, cider, malt or dilute alcohol are the bacteria acetobacter aceti and bacterium aceti. When these bacteria are allowed to enter the fermentation container, they cause aerobic oxidation of alcohol to dilute acetic acid, thereby producing vinegar. The diaphragm of the present invention does not allow these bacteria to enter the fermentation bag.

Another common contaminant found in the production of wine is moisture. The diaphragm of the present invention also does not allow the entrance of water into the fermentation bag.

SUMMARY OF THE INVENTION

Applicant has found a limited number of materials which can function as a diaphragm when sealed on the inside diameter of the cap described above. A spun bonded polyolefin such as polyethylene or polypropylene having a Gurley porosity of 2 to 120 seconds functions quite well as a diaphragm. Other materials which have been found to allow the escape of fermentation gases but do not allow bacteria or moisture therethrough are glassine paper and other paper having a Gurley porosity of 2 to 120 seconds. The spun bonded polyolefins having the required porosity are readily available, e.g. Tyvek 1073B from Dupont. Spun bonded polyolefins having a porosity of 2 to 120 seconds are well known.

Paper having the required porosity is easily made by controlling the degree of hydration of the pump during refinement and beating. This control of porosity is common in the paper art.

The fitment can be sealed to the plastic bag in any manner known in the art, for example, by heat sealing, solvent welding, gluing or otherwise adhesively fixing the fitment to the plastic bag. The diaphragm is sealed to the inside diameter of a plastic cap. The method of sealing the diaphragm to the cap is not critical. The diaphragm can be sealed in any manner known in the art, as for example those methods mentioned above for sealing the cap to the bag. The cap can be made to snap on to the fitment or it can be threaded to be screwed on and off of the fitment. The method of connecting the cap to the fitment is not critical as long as the two are in sealing engagement so that gas cannot escape the fermentation bag except by passing through the diaphragm.

In another embodiment of the present invention, the diaphragm is simply sealed directly over a hole in the plastic bag rather than using a fitment and cap as described above. The diaphragm is located at a position at the top of the bag when in position for fermentation. In both embodiments, the size of the diaphragm is sufficient to allow enough fermentation gas to escape so that pressure in the bag does not become excessive. The diaphragm size in each of these embodiments can vary with the amount of fermentable juice or mash placed in the container. The determination of diaphragm size is simple. Half to one inch diameter diaphragms are ample for home wine-making batches of up to 5 gallons. Larger batches require proportionately larger diaphragms, for example, 6–10 gallons require about 2 square inches of diaphragm area. Since there is no cap to be removed, another opening in the bag must be provided for filling and emptying. This embodiment is particularly useful in the "racking" of wines. In racking, a vertical rack holds a series of fermentation containers in vertical arrangement. In prior art racking procedures, after most of the sedimentation has accumulated, wine from the top fermentation container is siphoned to the next lower fermentation container. After further sedimentation in this next lower container, that wine is further siphoned to the third lower fermentation container and so on. In this manner, most of the sediment is confined to the uppermost container.

In accordance with the present invention, the wine stationed in the ordinary positions on a rack can be drained from the bottom of the fermentation container and thereby eliminate the extra energy requirements needed in siphoning. This can be done because the flexible bag when filled takes the shape of the rack on which it is placed. The rack can be made to have an inclined bottom surface so that the sediment settles at the lowermost end of the bag. In this manner, a tube can be positioned at the uppermost end of the bottom of the bag when placed in fermentation position. Since in ordinary operation there will be no sediment above this tube, the wine can simply be drained through the tube to the next lower fermentation container simply by opening a stopcock, pinch clamp or other type of valve connected to said tube.

Of course, the normal siphoning technique can also be used with the tube being positioned through the top of the plastic bag. When siphoning is preferred, a fitment can be sealed to the top of the bag having a snap-on cap as described in the first embodiment of this invention. The snap-on cap can have a diaphragm sealed therein as explained above or it can simply be sealed so that nothing passes therethrough when in sealing engagement with the fitment. When it is time to siphon the wine from the uppermost container to the next lower container, the cap can be removed and the siphon connected to the fitment. Of course, during fermentation, the fermentation gases are continuously passing through the diaphragm which is sealed to the plastic bag. By providing these racks with inclined bottom surfaces the fermentation process can be carried out quite conveniently and economically. In this manner, the fermentation containers themselves need not be manufactured with inclined bottom surfaces since the flexible bags disclosed herein will take the shape of the rack in which they are placed. At the end of the process, the bags which contain sediment can simply be thrown away since the replacement of the bags disclosed herein is less expensive than the labor involved in washing, rinsing and sterilizing an ordinary fermentation container.

BRIEF DESCRIPTION OF THE DRAWINGS

This invention is more particularly described with reference to the following drawings, in which.

DETAILED DESCRIPTION OF THE DRAWINGS AND PREFERRED EMBODIMENT

Figure 1:
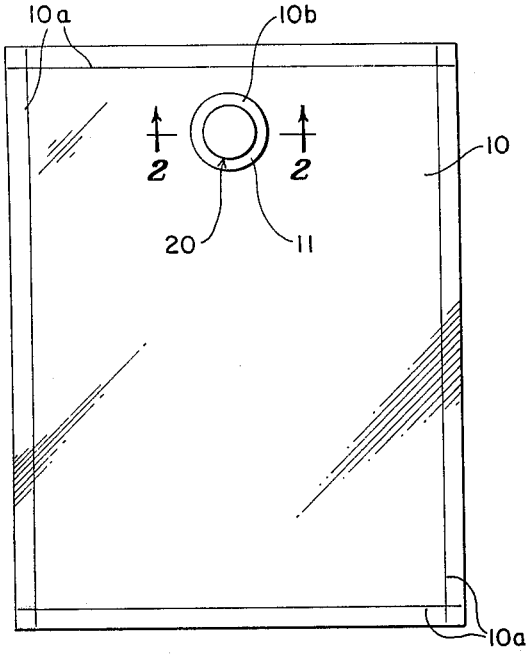
FIG. 1 is a top plan view of a plastic fermentation bag embodying the present invention.

Turning now more particularly to FIG. 1, a plastic bag or container 10 is there shown and comprises two or more nonporous polymeric sheets sealed together along their edges 10*a*, for example, by heat sealing, or in any other suitable manner. One of the sheets of the container 10 has a fitment or closure receiving structure 11 suitably secured thereto as by heat sealing a flanged portion 12 on the fitment 11 adjacent an opening 10*b* (FIGS. 1 and 2) formed near one end of the bag as shown in FIG. 1. The fitment or closure receiving structure 11 communicates with the opening 10*b* through which fluids are introduced into and discharged from the bag 10.

Figure 2:
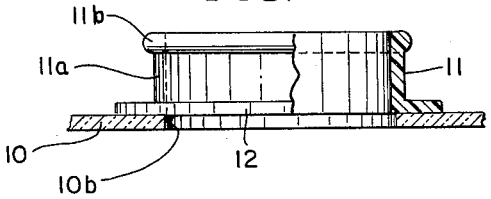
FIG. 2 is an enlarged fragmentary sectional view taken along line 2—2 in FIG. 1 showing a fitment which is sealed to the bag.

The fitment 11 is best shown in FIG. 2. Preferably, the fitment includes a cylindrical body portion 11*a* and an annular rim or shoulder 11*b*. The annular rim or shoulder portion functions as a snap-on fitting for the cap described with reference to FIG. 3. Of course, the fitment can have the annular rim or shoulder 11*b* shaped to protrude either outward or inward from the cylindrical body portion 11*a* for snapping the cap either around the outside or on the inside of the fitment.

Figure 3:
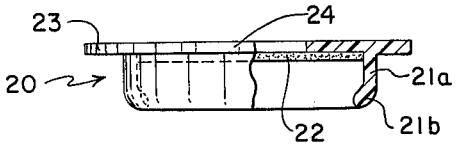
FIG. 3 is an elevational view in partial section illustrating a snap-on type cap for the fitment with a diaphragm within the cap.
Figure 4:
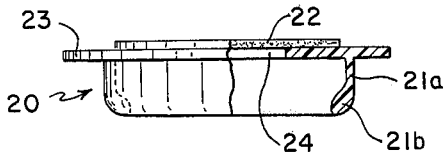
FIG. 4 is an elevational view in partial section illustrating another cap for the fitment in which the diaphragm is disposed on an outer surface of the cap.

FIGS. 3 and 4 show a cap or closure 20 with a diaphragm 22 sealed in alternate locations. An annular rim or shoulder portion 21*b* of the cap 20 is shaped complementary to the annular rim or shoulder 11*b* portion of the fitment 11 so that the cap 20 can be snapped onto the fitment 11 in sealing engagement therewith. The cap 20 and fitment 11 can also be threaded to provide a screw-on cap rather than a snap-on cap. A diaphragm 22 is sealed to the cap 20 either at its inside surface (FIG. 3) or its outside surface (FIG. 4). The diaphragm 22 is carried by the cap 20 as by sealing directly to the cylindrical body portion 21*a* of the cap, or it can be sealed to a top wall or covering 23 of the cap 20 so that fermentation gases must pass through both the diaphragm 22 and an opening 24 in the cap covering 23 to escape from the fermentation container 10.

Figure 5:
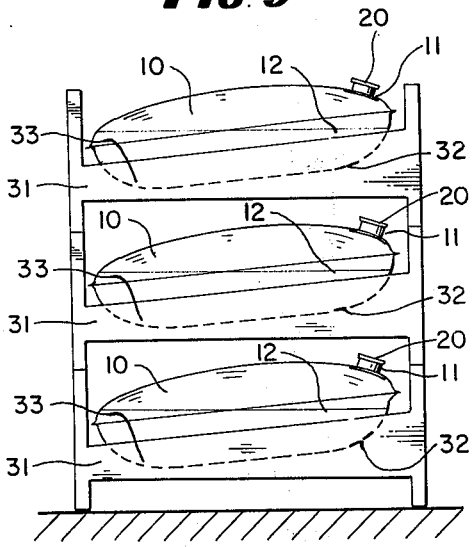
FIG. 5 is an elevational view illustrating a rack with vertically aligned fermentation bags.

FIG. 5 shows a vertical rack comprising a plurality of fermentation container trays 31 stacked one upon another and each having inclined bottom surfaces 32 on which the flexible fermentation containers 10 rest when in fermentation position. The flexible fermentation containers 10 conform to the shape of the inclined bottom surfaces 32 of the fermentation container trays 31. The inclination of the bottom surface 32 of each fermentation container 10 causes any sedimentation 33 which is formed during fermentation to accumulate at the lowermost end of the bag 10, thus leaving the higher end of the bag free from sediment. By arranging the bag so that the fitment 11 and the cap 20 are at the higher end of the bag when in fermentation position, the wine 12 can be siphoned from successive fermentation bags 10 without the removal of the sediment 33. When the sediment 33 becomes too cumbersome in some bags, those bags can be discarded and replaced.

Figure 6:
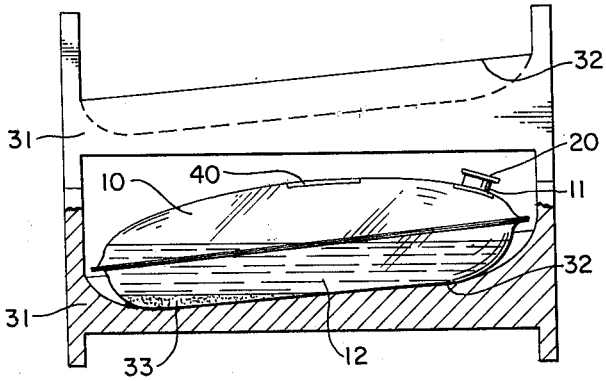
FIG. 6 is an elevational view showing another embodiment of the fermentation bag supported in a rack and having a diaphragm sealed directly over an opening in the plastic bag.

FIG. 6 shows another embodiment of the racking process and the bag or container 10 wherein a diaphragm or diaphragm material 40 is sealed directly to the fermentation container 10 over an opening in the upper wall of said container. In this embodiment, the fitment 11 and cap 20 can be constructed the same as in previous embodiments, or the cap 20 can simply be sealed so that all fermentation gases pass through the diaphragm 40. In this embodiment, the same type of trays 31 having inclined bottom surfaces 32 are used so that any sedimentation 33 formed during the fermentation of the wine 12 settles to the end of the container 10 opposite the end containing the fitment 11 and the cap 20. The cap 20 is removed and a tube (not shown) for siphoning is connected to the fitment 11 to remove the wine 12 from the container 10. In this embodiment, siphoning is required to remove the wine 12 to successive lower fermentation containers 10. During the siphoning procedure, only wine 12 and not sediment 33 is passed to each lower fermentation container 10.

Figure 7:
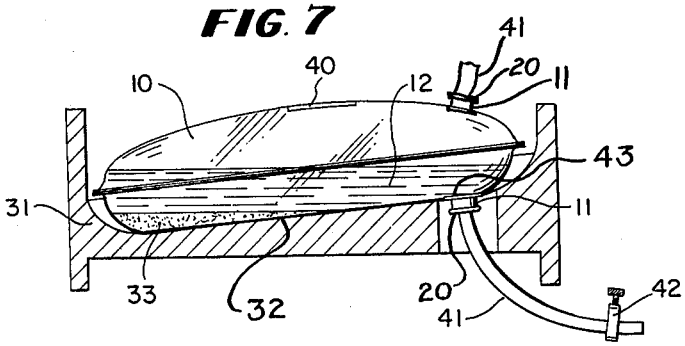
FIG. 7 is an elevational view of a wine making assembly including fermentation containers, each container having both a diaphragm sealed directly over a hole in the container and an assembly for draining the contents of the container by gravity.

In another embodiment shown in FIG. 7, a tray 31 having an inclined bottom surface 32 supports a container 10 having the diaphragm material 40 sealed directly to the fermentation container 10. In this embodiment, a drainage tube or conduit 41 is connected to the bottom of the fermentation container. The tray 31 is provided with an opening in the bottom surface 32 so that the drainage tube 41 can extend to the next lower fermentation container 10 when in a racking arrangement. The tube 41 can be connected to a fitment, as described above with reference to the attachment of the cap 20 to the fitment 11, or can be secured to the bag for the drainage of the wine 12 in any other manner. The tube 41 is provided with means for allowing and stopping the passage of the wine 12 therethrough. This can be a pinch clamp 42 as shown, a stopcock, a valve, or any other suitable means. When any sediment 33 approaches an opening 43 leading to the drainage tube 41, the fermentation container 10 is discarded together with the sediment 33, and a new container 10 is used.

While a preferred embodiment of the invention has been shown, it is to be understood that numerous modifications and changes will occur to those skilled in the art. The appended claims are intended to encompass all such modifications and changes as come within the true spirit and scope of the invention.

What is claimed as new and desired to be secured by Letters Patent of the United States is:

1. A fermentation container, comprising means for receiving a fermentable liquid and for storing said liquid during at least a portion of the fermentation of said liquid, said receiving and storing means comprising a nonporous plastic bag having an opening, a closure receiving structure secured to the bag communicating with said opening, a closure in sealing engagement with the structure and removable from the structure and diaphragm means disposed on said closure for enabling the escape of fermentation gases from said bag, said diaphragm means having a Gurley porosity in the range of 2 to 120 seconds and for preventing gas and moisture from entering said bag.

2. A fermentation container as defined in claim 1 in which the closure receiving structure and the closure are shaped for detachable sealing engagement.

3. A fermentation container as defined in claim 1 in which the closure receiving structure has an outside surface slightly larger than an inside surface of the closure so that the closure can be snapped into sealing engagement with the closure receiving structure.

4. A fermentation container as defined in claim 1 wherein the diaphragm is a spun bonded polyolefin having a Gurley porosity of 2 to 120 seconds.

5. A fermentation container as defined in claim 1 wherein the diaphragm is paper having a Gurley porosity of 2 to 120 seconds.

6. A fermentation container as defined in claim 5 wherein the paper is glassine.

7. A fermentation container as defined in claim 1 wherein the plastic bag is made from a material selected from the group consisting of polyolefin, ethylene-vinyl acetate copolymer, polyurethane, laminated polyethylene and polyvinylidene chloride, and a coextrusion of polyethylene and polyvinylidene chloride.

8. A fermentation container, comprising means for receiving a fermentable liquid and for storing said liquid during at least a portion of the fermentation of said liquid, said receiving and storing means comprising a nonporous plastic bag having an opening and diaphragm means disposed over said opening in said bag for enabling the escape of fermentation gases from said bag and for preventing bacteria organisms, spores, or any other contaminant from entering said bag said means having a Gurley porosity in the range of 2 to 120 seconds and disposed such that all gases leaving said bag during fermentation must pass through said means.

9. A fermentation container as defined in claim 8 which further includes a closure receiving structure sealed to said bag, an inside surface of the closure receiving structure defining an opening in the bag; and a closure in sealing engagement with the closure receiving structure and removable from said closure receiving structure, said closure having said diaphragm sealed to its inside surface.

10. A fermentation container, comprising means for receiving a fermentable liquid and for storing said liquid during at least a portion of the fermentation of said liquid, said receiving and storing means comprising a nonporous plastic bag having a top surface and a bottom surface;

a first opening in said top surface;

diaphragm means disposed over said first opening for enabling the escape of fermentation gases from said bag and for preventing bacteria organisms, spores, or any other contaminant from entering said bag, said means having a Gurley porosity in the range of 2 to 120 seconds and disposed such that all gases leaving said bag during fermentation must pass through said means;

a second opening in said top surface;

means disposed over said second opening for providing an inlet for a liquid into said container;

an opening in said bottom surface; and means disposed over said bottom surface opening for providing an outlet for said liquid from said container.

11. A container as defined in claim 10 wherein said second opening is disposed near one end of the top surface of said container and wherein said third opening is disposed near the same end of the bottom surface of said container.

12. A container as defined in claim 11 further including means for allowing and stopping the flow of liquid from said container.

* * * * *